US009110401B2

(12) United States Patent
Mori et al.

(10) Patent No.: US 9,110,401 B2
(45) Date of Patent: Aug. 18, 2015

(54) INTERVAL GUARANTEE MEMBER, DEVELOPING APPARATUS, PROCESS CARTRIDGE

(71) Applicant: CANON KABUSHIKI KAISHA, Tokyo (JP)

(72) Inventors: Tomonori Mori, Numazu (JP); Hiroki Ogino, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/257,851

(22) Filed: Apr. 21, 2014

(65) Prior Publication Data

US 2014/0314452 A1 Oct. 23, 2014

(30) Foreign Application Priority Data

Apr. 23, 2013 (JP) ..... 2013-090803

(51) Int. Cl.
*G03G 15/08* (2006.01)
*G03G 21/18* (2006.01)

(52) U.S. Cl.
CPC ..... *G03G 15/0813* (2013.01); *G03G 21/1821* (2013.01)

(58) Field of Classification Search
USPC ..... 399/279, 281
See application file for complete search history.

(56) References Cited

U.S. PATENT DOCUMENTS

| | | | | |
|---|---|---|---|---|
| 5,970,277 | A * | 10/1999 | Shigeta et al. | 399/45 |
| 6,044,235 | A * | 3/2000 | Hashimoto | 399/99 |
| 6,480,695 | B2 * | 11/2002 | Endo et al. | 399/349 |
| 2006/0099016 | A1 * | 5/2006 | Watanabe et al. | 399/351 |
| 2008/0175623 | A1 * | 7/2008 | Jeon | 399/222 |
| 2008/0304843 | A1 * | 12/2008 | Kosuge et al. | 399/50 |
| 2009/0180806 | A1 * | 7/2009 | Oshima et al. | 399/176 |
| 2011/0013938 | A1 * | 1/2011 | Tonohiro | 399/168 |
| 2012/0177407 | A1 * | 7/2012 | Lee et al. | 399/168 |
| 2014/0314444 | A1 * | 10/2014 | Ogino | 399/111 |

FOREIGN PATENT DOCUMENTS

| | | | |
|---|---|---|---|
| JP | 5-27571 | A | 2/1993 |
| JP | 2003-186303 | A | 7/2003 |

* cited by examiner

*Primary Examiner* — Clayton E LaBalle
*Assistant Examiner* — Warren K Fenwick
(74) *Attorney, Agent, or Firm* — Canon U.S.A., Inc. IP Division

(57) ABSTRACT

An interval guarantee member including: a first image bearing member side sliding portion in sliding-contact with the image bearing member; a first developing side sliding portion in sliding-contact with the developer bearing member; a second image bearing member side sliding contact portion in sliding-contact with the image bearing member; and a second developing side sliding contact portion in sliding-contact with the developer bearing member, wherein the distance between the first image bearing member side sliding contact portion and the first developing side sliding contact portion is longer than that between the second image bearing member side sliding contact portion and the second developing side sliding contact portion, and the first image bearing member side sliding contact portion and the first developer side sliding contact portion come into contact with the image bearing member and the developer bearing member.

33 Claims, 14 Drawing Sheets

INTERVAL GUARANTEE MEMBER, DEVELOPING APPARATUS, PROCESS CARTRIDGE

BACKGROUND OF THE INVENTION

1. Field of the Invention

The present disclosure relates to an interval guarantee member used for an image forming apparatus, a process cartridge and a developing apparatus having the interval guarantee member.

The term the image forming apparatus used here includes, for example, an electrophotographic image forming apparatus configured to form images on recording media by using an electrophotographic image forming system. Examples of the electrophotographic image forming apparatus includes, for example, electrophotographic copying machines, electrophotographic printers (for example, laser beam printers, LED printers), facsimile apparatus, and word processors.

The term, the interval guarantee member is a member configured to maintain the distance between an image bearing member and a developer bearing member used for the image forming apparatus constant.

2. Description of the Related Art

In the related art, an electrophotographic image forming apparatus such as an electrophotographic copying machine or a laser beam printer selectively exposes an electrophotographic photosensitive member (image bearing member), which is uniformly charged by a charging device, forms a latent image, and makes the latent image visible by a developing device with toner. Image recording is performed by transferring and fixing a toner image on the recording medium. Toner remaining on the electrophotographic photosensitive member after the transfer is cleaned and removed by a cleaning device.

The image forming apparatus having the configuration as described above is provided with an interval guarantee member as a device for controlling the interval between a photosensitive drum and a developing roller constant.

As an example of the interval guarantee member composed of a member, a method of interposing a roll-type member between the photosensitive drum and the developing roller by an urging force of a spring or the like, and defining the interval between the photosensitive drum and the developing roller constant by the thickness of a roller is known. Here, the roller maintains the interval between the photosensitive drum and the developing roller while being rotated by the rotation of one of the photosensitive drum and the developing roller, which rotate so that peripheral surfaces thereof move in the same direction at an opposing portion. Therefore, in order to suppress variations of the clearance in this device caused by the rotation of the roller, the variations in the thickness need to be suppressed so as to obtain the roller having a uniform thickness over the entire circumference.

In contrast, a fixed interval guarantee member which is not rotated in association with the photosensitive drum or the developing roller is also proposed (refer to Japanese Patent Laid-Open No. 5-27571). In Japanese Patent Laid-Open No. 5-27571, a sheet-type interval retaining member is fixed in a state of being interposed between the photosensitive drum and the developer roller. As an advantage of this system is that variations of the interval caused by the rotation of the roller is reduced because a contact portion on the side of the interval guarantee member is always constant with respect to the rotation of the roller. In this case, in order to prevent the sheet-type interval guarantee member from being rotated in association with the photosensitive drum and the developing roller, one end of the sheet, which is the interval guarantee member, is fixed to the image forming apparatus to restrict the movement of the interval guarantee member. Therefore, an adhesive agent or double-faced tape as a fixing device needs to be provided separately from the sheet, which is the interval guarantee member.

SUMMARY OF THE INVENTION

This disclosure intends to maintain the distance between the image bearing member and the developer bearing member stably in a simple configuration by further improving the above-described related art.

A representative configuration disclosed in this application is: an interval guarantee member configured to maintain a distance between an image bearing member on which a latent image is formed and a developer bearing member configured to bear a developer, including: a first image bearing member side sliding portion configured to come into sliding contact with the image bearing member on an upstream side of a line connecting a center of the image bearing member and a center of the developer bearing member in the direction of rotation of the image bearing member when the image bearing member and the developer bearing member rotate so that surfaces oppose to each other thereof move in the same direction; a first developing side sliding portion configured to come into sliding contact with the developer bearing member on an upstream side of a line connecting a center of the image bearing member and a center of the developer bearing member in the direction of rotation of the developer bearing member when the image bearing member and the developer bearing member rotate so that surfaces oppose to each other thereof move in the same direction; a second image bearing member side sliding contact portion configured to come into sliding contact with the image bearing member on an downstream side of the first image bearing member side sliding portion in the direction of rotation of the image bearing member; and a second developing side sliding contact portion configured to come into sliding contact with the developer bearing member on an downstream side of the first developing side sliding contact portion in the direction of rotation of the developer bearing member, wherein the distance between the first image bearing member side sliding contact portion and the first developing side sliding contact portion is longer than the distance between the second image bearing member side sliding contact portion and the second developing side sliding contact portion, and the first image bearing member side sliding contact portion and the first developer side sliding contact portion come into contact with the image bearing member and the developer bearing member respectively, whereby the interval guarantee member is prevented from moving in the direction of rotation of the image bearing member and the developer bearing member.

Another configuration disclosed in this application is a developing apparatus used in an image forming apparatus, including: a developer bearing member configured to bear a developer for developing the latent image and rotate so that the surface thereof moves in the same direction as the image bearing member at an area opposing each other; and an interval guarantee member configured to maintain the distance between the image bearing member and the developer bearing member, wherein the interval guarantee member includes: a first image bearing member side sliding portion configured to come into sliding contact with the image bearing member on an upstream side of a line connecting a center of the image bearing member and a center of the developer bearing member when the image bearing member and the developer bearing member rotate so that surfaces oppose to each other thereof move in the same direction; a first developing side sliding portion configured to come into sliding contact with the developer bearing member on an upstream side of a line connecting a center of the image bearing member and a center of the developer bearing member in the direction of rotation of the image bearing member when the image bearing member and the developer bearing member rotate so that surfaces oppose to each other thereof move in the same direction; a second image bearing member side sliding contact portion configured to come into sliding contact with the image bearing member on an downstream side of the first image bearing member side sliding portion in the direction of rotation of the image bearing member; and a second developing side sliding contact portion configured to come into sliding contact with the developer bearing member on an downstream side of the first developing side sliding contact portion in the direction of rotation of the developer bearing member, wherein the distance between the first image bearing member side sliding contact portion and the first developing side sliding contact portion is longer than the distance between the second image bearing member side sliding contact portion and the second developing side sliding contact portion, and the first image bearing member side sliding contact portion and the first developer side sliding contact portion come into contact with the image bearing member and the developer bearing member respectively, whereby the interval guarantee member is prevented from moving in the direction of rotation of the image bearing member and the developer bearing member.

Still another configuration is a process cartridge configured to be detachably attachable to a main body of an image forming apparatus including: an image bearing member configured so that a latent image is formed thereon; the developer bearing member configured to bear a developer for developing the latent image and rotate so that the surface thereof moves in the same direction as the image bearing member at an area opposing each other; and an interval guarantee member configured to maintain the distance between the image bearing member and the developer bearing member, wherein the interval guarantee member includes: a first image bearing member side sliding portion configured to come into sliding contact with the image bearing member on an upstream side of a line connecting a center of the image bearing member and a center of the developer bearing member in the direction of rotation of the image bearing member when the image bearing member and the developer bearing member rotate so that surfaces oppose to each other thereof move in the same direction; a first developing side sliding portion configured to come into sliding contact with the developer bearing member on an upstream side of a line connecting a center of the image bearing member and a center of the developer bearing member in the direction of rotation of the developer bearing member when the image bearing member and the developer bearing member rotate so that surfaces oppose to each other thereof move in the same direction; a second image bearing member side sliding contact portion configured to come into sliding contact with the image bearing member on an downstream side of the first image bearing member side sliding portion in the direction of rotation of the image bearing member; and a second developing side sliding contact portion configured to come into sliding contact with the developer bearing member on an downstream side of the first developing side sliding contact portion in the direction of rotation of the developer bearing member, wherein the distance between the first image bearing member side sliding contact portion and the first developing side sliding contact portion is longer than the distance between the second image bearing member side sliding contact portion and the second developing side sliding contact portion, and the first image bearing member side sliding contact portion and the first developer side sliding contact portion come into contact with the image bearing member and the developer bearing member respectively, whereby the interval guarantee member is prevented from moving in the direction of rotation of the image bearing member and the developer bearing member.

Further features of the present invention will become apparent from the following description of exemplary embodiments with reference to the attached drawings.

DESCRIPTION OF THE EMBODIMENTS

EXAMPLE 1

Subsequently, a process cartridge and an electrophotographic image forming apparatus on which the process cartridge is detachably attachable according to an embodiment of this disclosure will be described with reference to the drawings.

In the embodiment, an electrophotographic image forming apparatus configured to form images on an electrophotographic photosensitive member by using an image forming process on the basis of an electrophotographic system, and the process cartridge configured to be detachably attachable thereto are exemplified.

Description of General Electrophotographic Image Forming Apparatus

First of all, a general configuration of the electrophotographic image forming apparatus will be described with reference to FIGS. 1 and 2.

Figure 1:
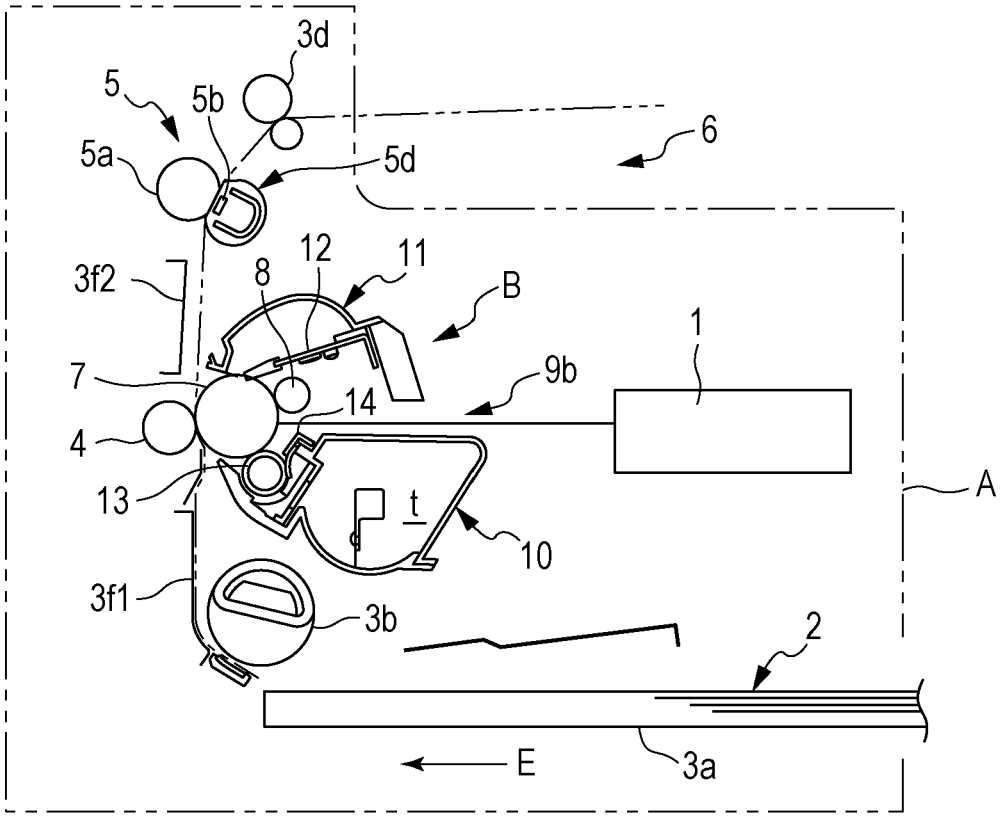
FIG. 1 is a cross-sectional side view illustrating an entire configuration of an image forming apparatus.

FIG. 1 is a cross-sectional side view illustrating a state in which a process cartridge to which this disclosure is applicable is mounted on the image forming apparatus. FIG. 2 is a cross-sectional side view illustrating the process cartridge to which this disclosure is applicable.

Image forming performed by the electrophotographic image forming apparatus of the embodiment will be described. As illustrated in FIG. 1, an electrophotographic photosensitive member (hereinafter, referred to as "photosensitive drum") 7 having a drum shape and provided with a photosensitive layer is irradiated with a laser beam image on the basis of image information from an optical system 1. With this operation, an electrostatic latent image is formed on the photosensitive drum 7. Subsequently, a voltage is applied to a developing roller 13, which corresponds to a developer bearing member configured to bear a developer t, whereby the developer t is moved from the developing roller 13 to the photosensitive drum 7. Accordingly, an image of the developer t is formed on the photosensitive drum 7. Subsequently, a recording material 2, which corresponds to a recording medium (recording sheet, OHP sheet, and the like), is guided from a cassette 3*a* by conveying means 3*b* along a guide plate 3*f*1 and conveyed synchronously with the formation of a developer image. The developer image formed on the photosensitive drum 7 in an image forming unit which has a structure of a cartridge as a process cartridge B is transferred to the recording material 2 by a voltage applied to a transfer roller 4, which corresponds to a transfer device. The recording material 2 is then guided by a guide plate 3*f*2, and is conveyed to a fixing device 5. The fixing device 5 includes a fixing roller 5*d* having a drive roller 5*a* and a heater 5*b* integrated therein. The recording material 2 passing through the fixing device 5 is conveyed by a discharge roller pair 3*d*, and is discharged to a discharge unit 6 through a reversal conveyance path. The image forming apparatus of this configuration also supports a manual feed by using a manual feed tray and a roller, which are not illustrated.

Configuration of Process Cartridge

A process cartridge B includes the photosensitive drum 7 and the developing roller 13 configured to develop the electrostatic latent image formed on the photosensitive drum 7 at least as a process device. The process cartridge is configured to be detachably attachable with respect to a main body of an image forming apparatus A.

Figure 2:
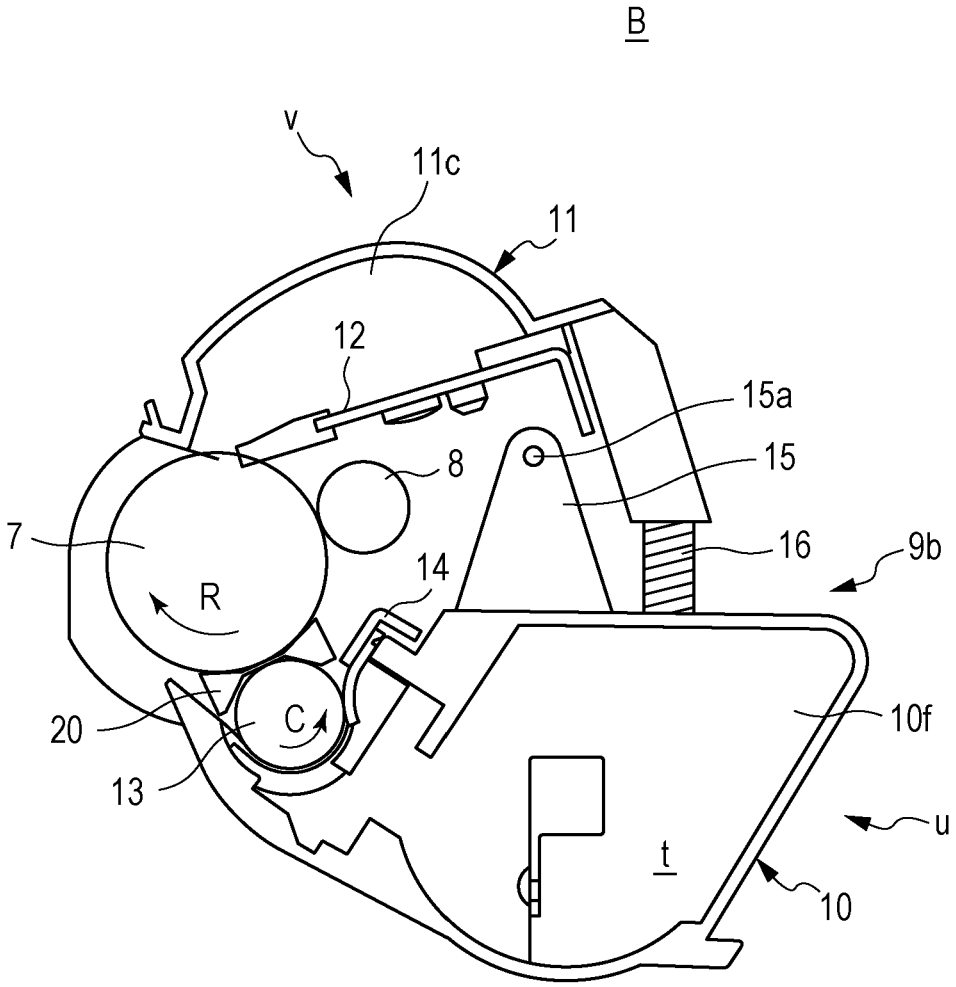
FIG. 2 is a cross-sectional side view illustrating a general configuration of a process cartridge.

As illustrated in FIG. 2, when forming an image by using the process cartridge B of the embodiment, the photosensitive drum 7 rotates in a direction indicated by an arrow R. The surface of the photosensitive drum 7 is uniformly charged by a charge roller 8, which corresponds to a charging device. Light from the optical system 1 passes through an exposure opening 9*b* formed in a cleaning frame member 11, which corresponds to a photosensitive drum frame, and exposes a peripheral surface of the photosensitive drum 7. With this operation, an electrostatic latent image is formed on the photosensitive drum 7. A developing container 10 is provided with a developer restricting member (developing blade) 14 and the developing roller 13. The developing container 10 includes a developer storage section 10*f* configured to store the developer t to be supplied to the developing roller 13. The developer t on the developing roller 13 is restricted by the developing blade 14, whereby a uniform developer layer is formed on the developing roller 13 which rotates in the direction indicated by an arrow C. A developing bias is applied to the developing roller 13, whereby the developer t is moved to the photosensitive drum 7 according to the latent image. Accordingly, the developer image in accordance with the latent image is formed on the photosensitive drum 7. The developer image is then transferred to the recording material 2 by a transfer bias applied to the transfer roller 4. The developer t remaining on the photosensitive drum 7 after the developer image has transferred to the recording material 2 is removed by the cleaning blade 12, which corresponds to a cleaning device. The removed developer t is collected to a removed developer storage section 11*c*.

The process cartridge B is mainly divided into a photosensitive unit (image bearing unit) v and a developing unit u as units. The photosensitive unit v at least includes the cleaning frame member 11, the photosensitive drum 7, the charge roller 8, and the cleaning blade 12. The developing unit u is a developing apparatus having at least the developing container 10, the developing roller 13, and the developing blade 14.

The photosensitive unit v and the developing unit u are coupled with, for example, a metallic pin or the like, which is not illustrated, so as to be capable of rotating with respect to each other about a hole portion 15*a* provided in an arm portion 15 of the developing unit u. A pressing spring 16 is arranged between the photosensitive unit v and the developing unit u. The developing unit u is rotated about the hole portion 15*a* by the pressing spring 16, whereby the developing roller 13 is urged toward the photosensitive drum 7. Interval guarantee members 20 to be interposed between the both rollers are provided in order to maintain the distance between the developing roller 13 and the photosensitive drum 7 (in this example, a size of a clearance between the surface of the developing roller 13 and the surface of the photosensitive drum) constant.

Figure 3:
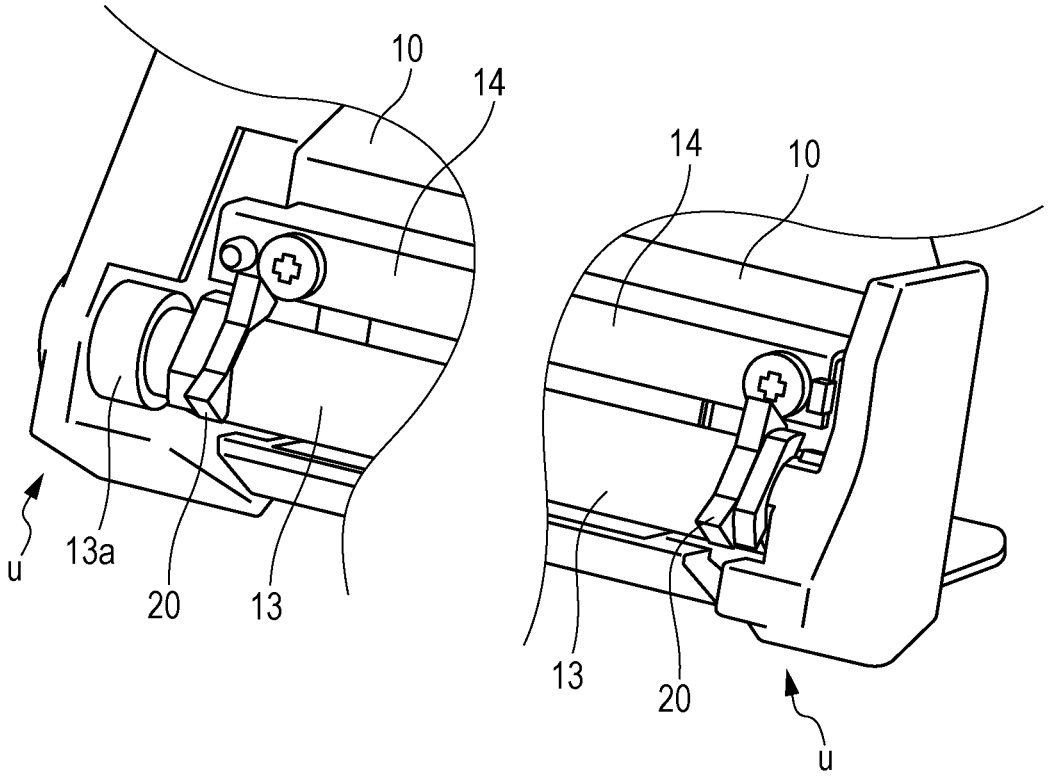
FIG. 3 is a perspective view of a developing unit.
Figure 4:
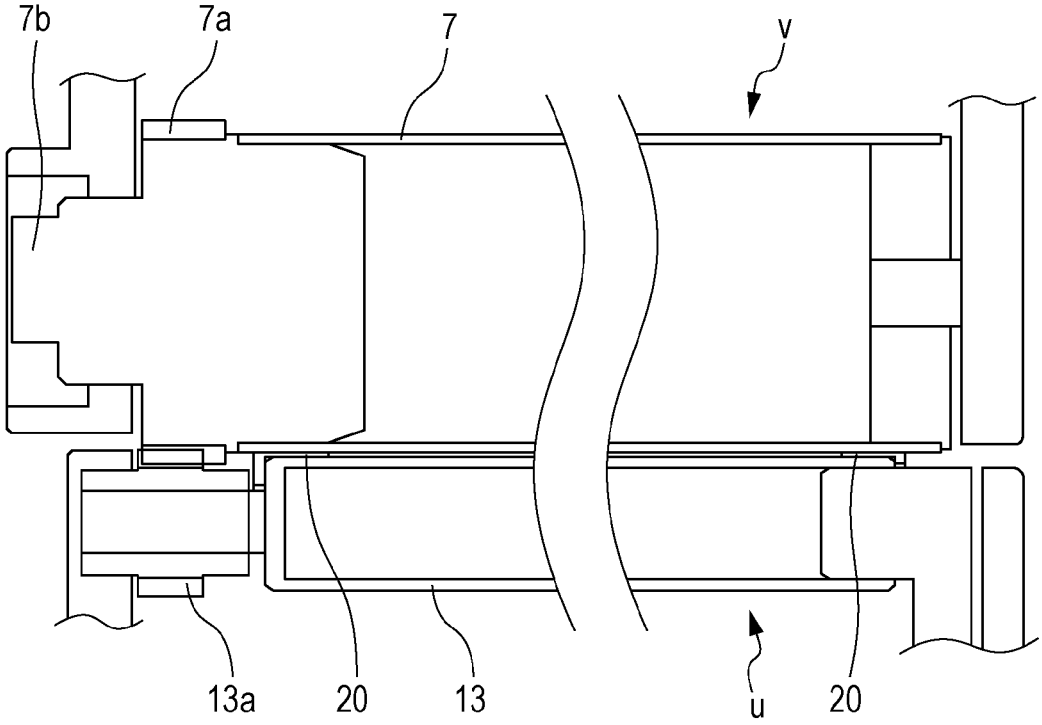
FIG. 4 is a cross-sectional view in a longitudinal direction of the process cartridge.

Interval Guarantee Member Configured to Hold Clearance Between Developing Roller and Photosensitive Drum As illustrated in FIG. 3, the interval guarantee members 20 are attached to both ends of the developing roller 13 of the developing unit u. The interval guarantee members 20 are rotatable with respect to the developing roller 13. FIG. 4 illustrates a longitudinal cross-sectional view of the process cartridge B. In this manner, the clearance between the developing roller 13 and the photosensitive drum 7 is maintained constant along the longitudinal direction by the interval guarantee members 20 arranged at the both end portions of the developing roller 13.

The photosensitive drum 7 receives a drive force from an engaging portion 7*b* with respect to a main body of the image forming apparatus provided at an end as illustrated in FIG. 4, and hence is driven into rotation. The developing roller 13 is driven into rotation by a drive force transmitted thereto by an engagement of a drum gear 7*a* formed at one end of the photosensitive drum 7 with sleeve developing roller gear 13*a* formed at an end of the developing roller 13.

In the following description, although there are two interval guarantee members 20, only one of the interval guarantee members 20 may be described for the sake of simplification of the description. The interval guarantee member 20 of the example includes a first drum contact portion (first image baring member side sliding contact portion) 20*c* that comes into sliding contact with the photosensitive drum 7 when the photosensitive drum 7 and the developing roller 13 rotate. In addition, the interval guarantee member 20 includes a second drum contact portion (second image bearing member side sliding contact portion) 20*a* that comes into sliding contact with the photosensitive drum 7 on the downstream side the first drum contact portion in the direction of rotation of the photosensitive drum 7. Furthermore, the interval guarantee member 20 includes a first developing roller contact portion (first developing side sliding contact portion) 20*d* that comes into sliding contact with the developing roller 13. Furthermore, the interval guarantee member 20 includes a second developing roller contact portion (second developing side sliding contact portion) 20*b* that comes into sliding contact with the developing roller 13 on the downstream side of the first developing roller contact portion in the direction of rotation of the developing roller. Characteristics of respective contact portions (sliding contact portions) will be described in detail below.

Figure 5:
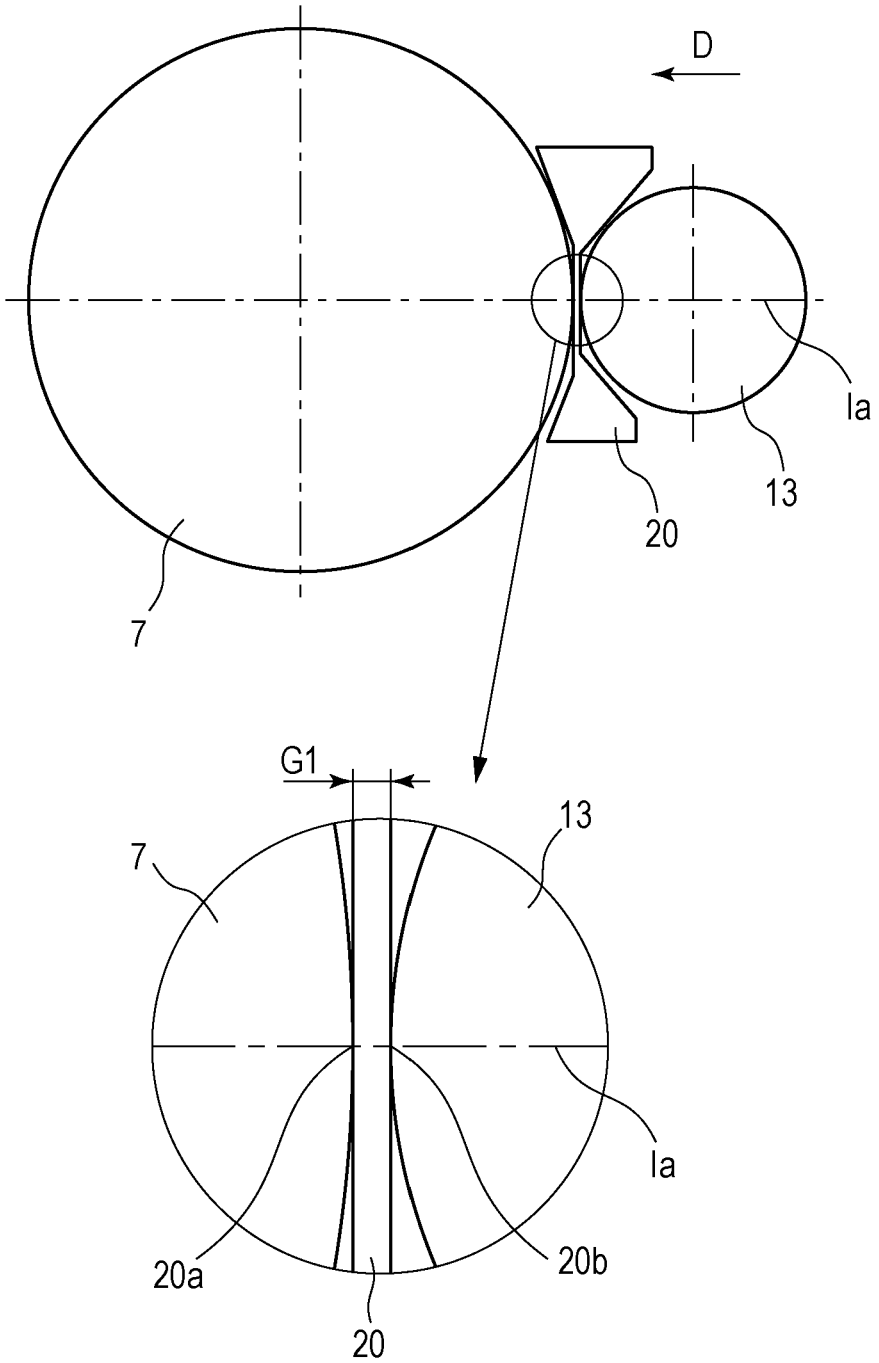
FIG. 5 is a cross-sectional view of an interval guarantee member when a photosensitive drum and a developing roller are standstill.

FIG. 5 is a cross-sectional view (a cross section orthogonal to an axis of the developing roller 13) illustrating a relationship of the interval guarantee member 20 with respect to the photosensitive drum 7 and the developing roller 13. When the developing roller 13 is urged toward the photosensitive drum 7 in the direction indicated by an arrow D by an urging force from the pressing spring 16 described above, the second drum contact portion 20*a* and the second developing roller contact portion 20*b* of the interval guarantee member 20 come into contact with the surfaces of the photosensitive drum 7 and the developing roller 13, respectively. The clearance between the photosensitive drum 7 and the developing roller 13 is maintained constant by a thickness G1 of flat portion of the interval guarantee member 20. In other words, the distance between the photosensitive drum 7 and the developing roller 13 is defined by the distance (thickness G1) of the second drum contact portion 20*a* and the second developing roller contact portion 20*b*.

Subsequently, in FIG. 6, a case where the photosensitive drum 7 and the developing roller 13 are driven into rotation in directions indicated in the drawing by arrow R and C respectively so that opposed surfaces move in the same direction with the configuration described above will be described. In this case, the interval guarantee member 20 receives a force in a direction indicated by an arrow H by a frictional force acting between the interval guarantee member 20 and the photosensitive drum 7 and between the interval guarantee member 20 and the developing roller 13. Subsequently, a first drum contact portion 20*c* and a first developing roller contact portion 20*d* of the interval guarantee member 20 come into contact with the surfaces of the photosensitive drum 7 and the developing roller 13, respectively. The first drum contact portion 20*c* and the first developing roller contact portion 20*d* are in a region on the upstream side from a line 1*a* connecting a center of the photosensitive drum 7 and a center of the developing roller 13 in the direction of rotation as indicated by an arrow E. The first drum contact portion 20*c* and the first developing roller contact portion 20*d* are provided so as to restrict the movement of the interval guarantee member 20 by the contact between the photosensitive drum 7 and the developing roller 13, respectively. Accordingly, a phenomenon that the interval guarantee member 20 is rotated together with the developing roller 13 caused by being separated from the surface of the photosensitive drum 7 at the second drum contact portion is prevented. The posture of the interval guarantee member 20 is maintained constant by the first drum contact portion 20*c* and the first developing roller contact portion 20*d*, whereby the positions of the second drum contact portion 20*a* and the second developing roller contact portion 20*b* are stabilized.

In other words, the distance between the first drum contact portion 20*c* and the first developing roller contact portion 20*d* is longer than the distance between the second drum contact portion 20*a* and the second developing roller contact portion 20*b*. Therefore, the first drum contact portion 20*c* and the first developing roller contact portion 20*d* can prevent the interval guarantee member 20 from moving in the direction of rotation of the photosensitive drum 7 and the developing roller 13 by coming into contact with the photosensitive drum 7 and the developing roller 13, respectively.

The clearance between the photosensitive drum 7 and the developing roller 13, which is maintained constant by the thickness G1 of the flat portion of the interval guarantee member 20 is then stabilized. In this embodiment, the second drum contact portion 20*a* and the second developing roller contact portion 20*b* are both located at a position where the photosensitive drum 7 and the developing roller 13 are closest. In other words, the second drum contact portion 20*a* and the second developing roller contact portion 20*b* are located on a line (on 1*a*) which passes through the center of the photosensitive drum 7 and the center of the developing roller 13.

Figure 7:
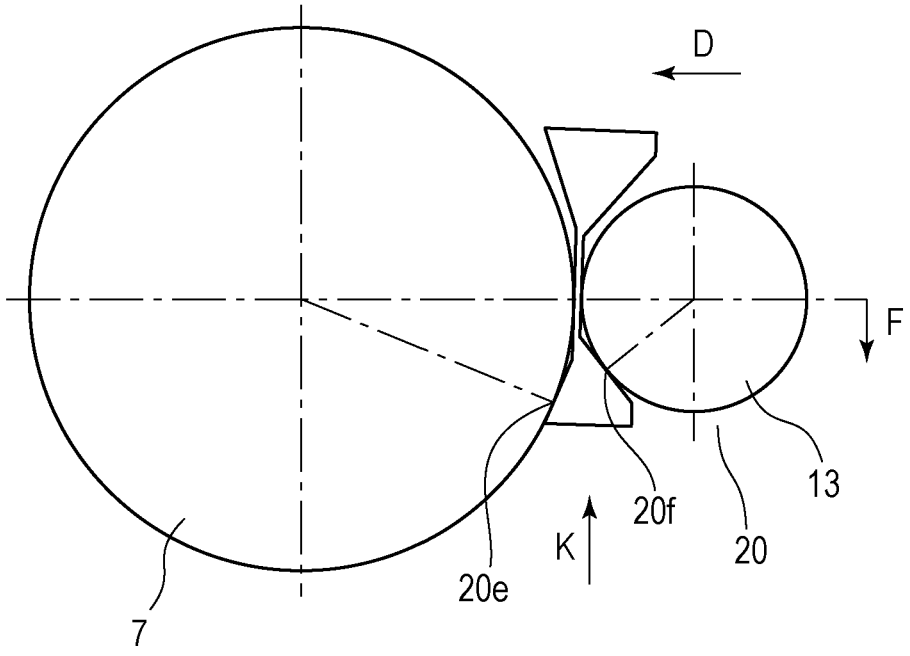
FIG. 7 is a cross-sectional view of the interval guarantee member when the photosensitive drum and the developing roller are standstill.

Subsequently, a case where the photosensitive drum 7 and the developing roller 13 do not form an image, that is, do not rotate will be described in FIG. 7. In this case, for example, at the time of physical distribution of the process cartridges, the interval guarantee member 20 may drop out from the both rollers due to an external force such as an impact force. In order to prevent such an event, the interval guarantee member 20 is provide with a first movement restricting portion 20*e* and a second movement restricting portion 20*f*. The first movement restricting portion 20*e* and the second movement restricting portion 20*f* serve to prevent the interval guarantee member 20 from moving in a direction opposite to the direction of rotation of the photosensitive drum 7 and the developing roller 13.

In other words, the first and the second movement restricting portions 20*e* and 20*f* are configured to prevent the interval guarantee member 20 from moving in a direction indicated by an arrow K. The first and the second movement restricting portions 20*e* and 20*f* are located on an opposite side from the first drum contact portion 20*c* and the first developing roller contact portion 20*d* described above, that is, in a region on the downstream side from the line 1*a* connecting the center of the photosensitive drum 7 and the center of the developing roller 13 in the direction of rotation as indicated by an arrow F. Dropping out of the interval guarantee member 20 is prevented from the first and the second movement restricting portions 20*e* and 20*f* coming into abutment (contact) with he photosensitive drum 7 and the developing roller 13, respectively.

In other words, the distance between the first movement restricting portion 20*e* and the second movement restricting portion 20*f* is larger than the distance (thickness G1) between the second drum contact portion 20*a* and the second developing roller contact portion 20*b*. Therefore, the first and the second movement restricting portions 20*e* and 20*f* can prevent the interval guarantee member 20 from moving in the direction opposite to the direction of rotation of the photosensitive drum 7 and the developing roller 13.

Figure 6:
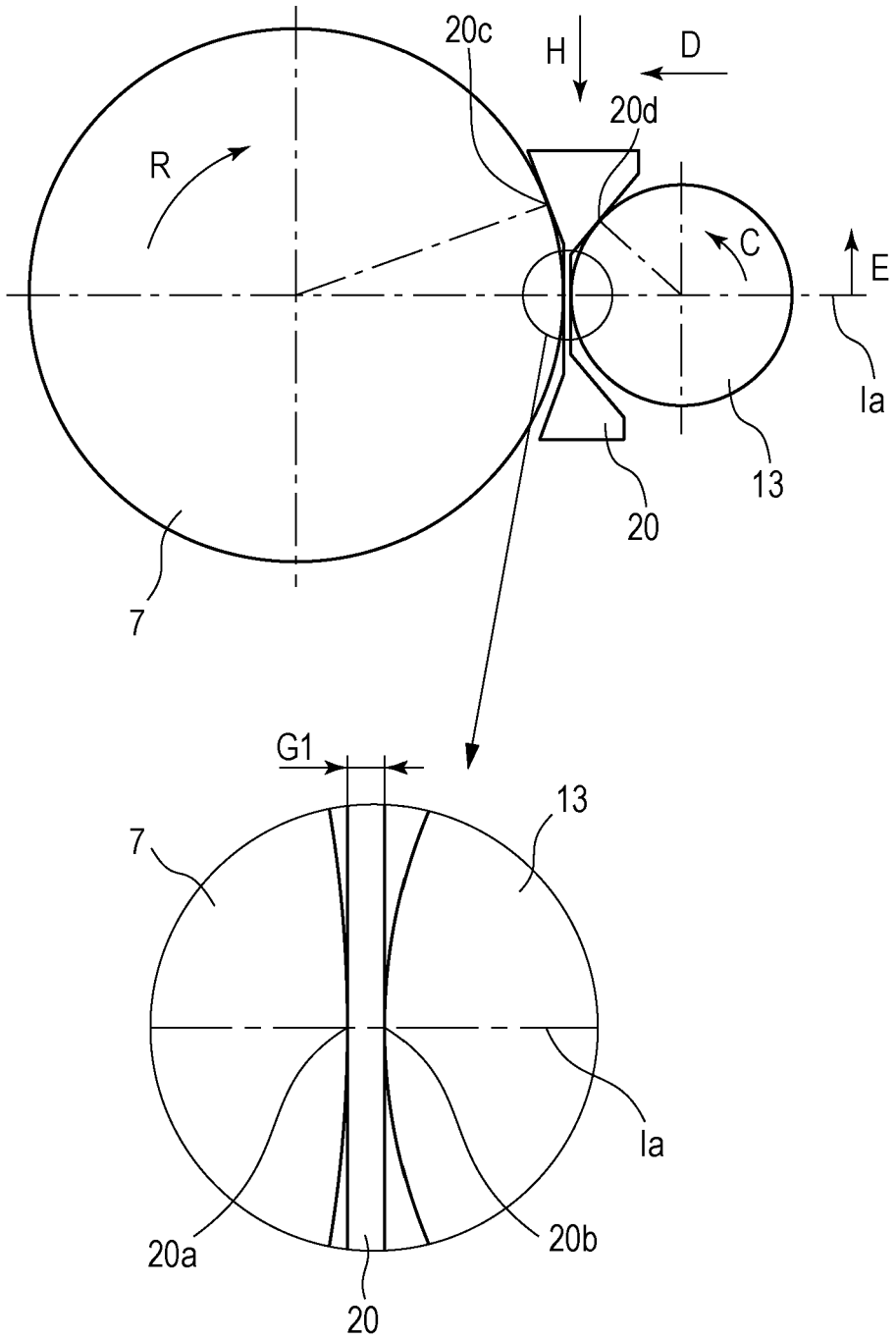
FIG. 6 is a cross-sectional view of the interval guarantee member when the photosensitive drum and the developing roller are driven.

When the photosensitive drum 7 and the developing roller 13 are driven into rotation in subsequent image forming, the interval guarantee member 20 is returned back to the posture illustrated in FIG. 6 by a frictional force acting between the photosensitive drum 7 and the developing roller 13, and the first and the second movement restricting portions 20*e* and 20*f*. At this time, the first and the second movement restricting portions 20*e* and 20*f* maintain a state of not coming into contact with the photosensitive drum 7 and the developing roller 13 (a state arranged at a distance therefrom), respectively.

Subsequently, a change of the clearance between the photosensitive drum 7 and the developing roller 13 in a case where the dimensional accuracy of the interval guarantee member 20 varies will be described with reference to FIG. 8 and FIG. 9.

Figure 8:
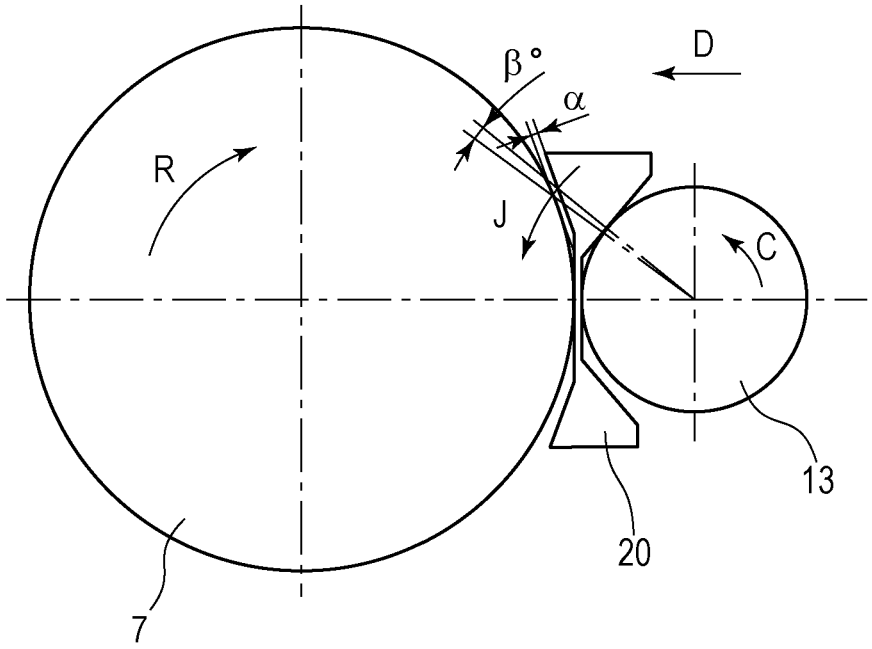
FIG. 8 is a cross-sectional view of the interval guarantee member when the photosensitive drum and the developing roller are standstill.
Figure 9:
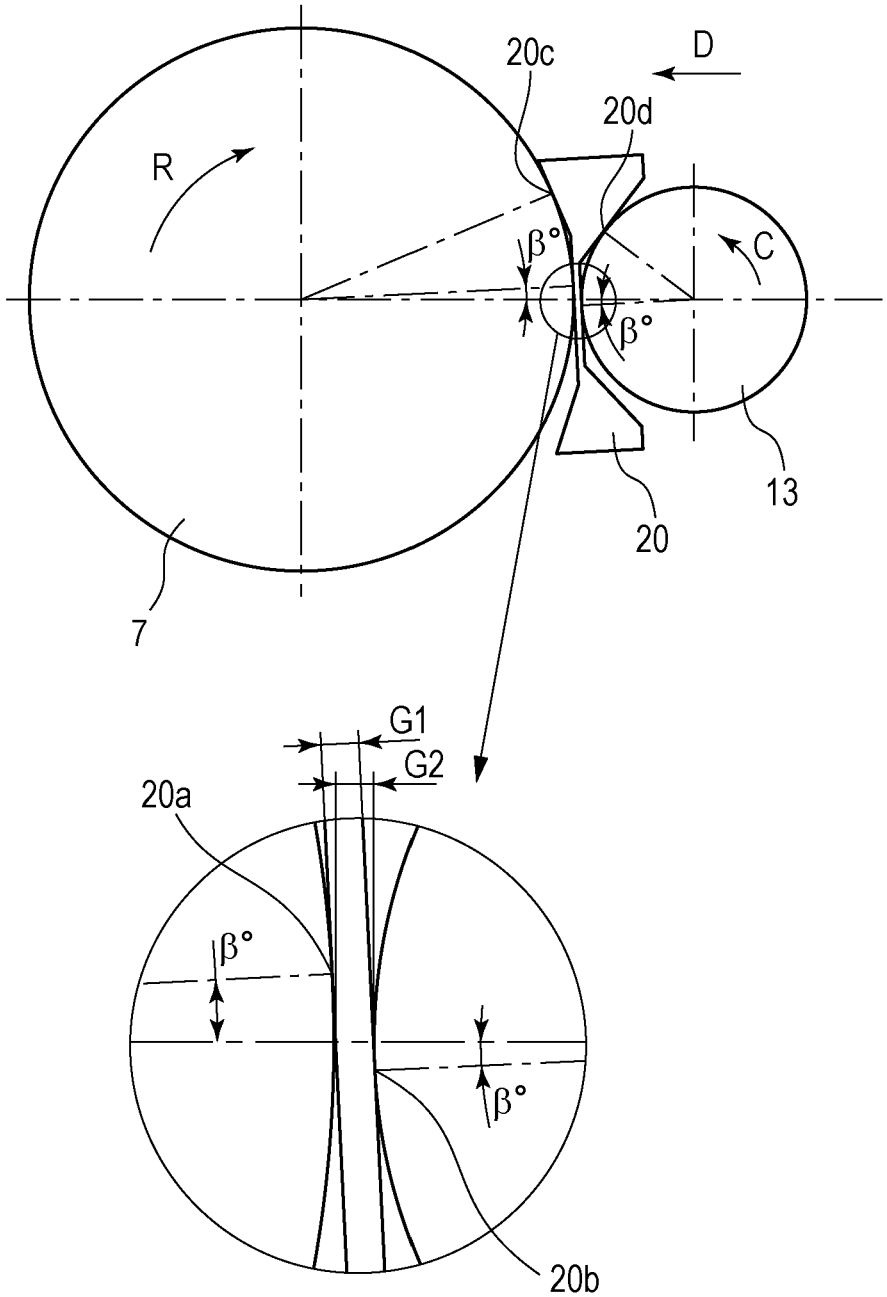
FIG. 9 is a cross-sectional view of the interval guarantee member when the photosensitive drum and the developing roller are driven.

FIG. 8 illustrates a state in which the surface of the first drum contact portion 20*c* with respect to the photosensitive drum 7 is shifted by α due to variations in dimension of the interval guarantee member 20. In this case, the interval guarantee member 20 rotates β° in a direction indicated by an arrow J until the first drum contact portion 20*c* comes into contact with the photosensitive drum 7 by a frictional force generated when the photosensitive drum 7 and the developing roller 13 rotate. FIG. 9 illustrates a state in which the interval guarantee member 20 rotates and comes into contact with the photosensitive drum 7. Here, the positions of the second drum contact portion 20*a* and the second developing roller contact portion 20*b* of the interval guarantee member 20 are such that the contact position therebetween is shifted in the vertical direction by β° as illustrated. Therefore, the amount of the clearance between the photosensitive drum 7 and the developing roller 13 is changed from a distance G1 at the flat portion of the interval guarantee member, which is an intended amount of a clearance to a distance G2. For example, when the positional displacement of the contact portion is α=0.1 mm, and the angle of rotation β°≈1°, and the amount of change of the clearance G2−G1 becomes on the order of 2.5 low μm (where the photosensitive drum has ϕ24, the developing roller has ϕ10, and G1=0.3).

As described thus far, the second drum contact portion 20*a* and the second developing roller contact portion 20*b* are formed into flat portions parallel to each other, so that the amount of change of the clearance (G2−G1) may be suppressed to be sufficiently small with respect to the positional displacement α of the contact portion.

The term "flat portions parallel to each other" is not intended to limit the same to be completely parallel. These two planes may have a minute angle as long as the angle is small within a range in which the amount of change of the clearance (G2−G1) is accepted.

The amount of change of the clearance between the flat portions may be suppressed not only in the case of positional displacement of the first drum contact portion 20*c* with respect to the photosensitive drum 7, but also in a case of the positional displacement of the first developing roller contact portion 20*d* which comes into contact with the developing roller 13 by using the same action.

EXAMPLE 2

Configurations of other examples of this disclosure will be described.

Figure 10:
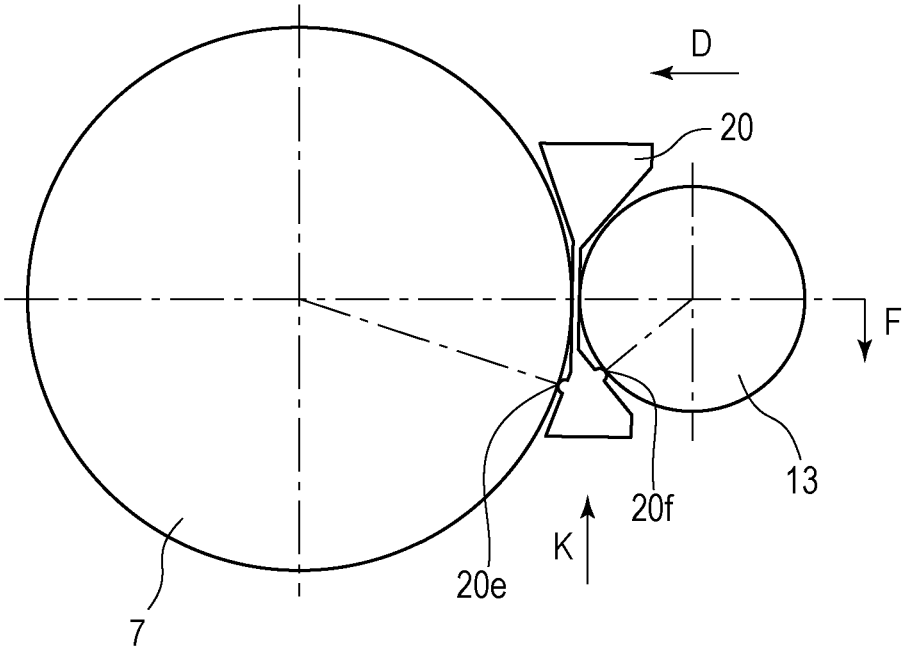
FIG. 10 is a cross-sectional view of the interval guarantee member of Example 2.

In FIG. 10, the first movement restricting portion 20*e* and the second movement restricting portion 20*f* are formed into a rib shape. FIG. 10 illustrates a state in which the interval guarantee member 20 receives a force in a direction indicated by the arrow K by an impact or the like during the physical distribution, and the first movement restricting portion 20*e* and the second movement restricting portion 20*f* come into contact with the photosensitive drum 7 and the developing roller 13. In this manner, the effect is achieved irrespective of the shape of the movement restricting portion as long as the movement restricting portion of the interval guarantee member 20 are in the region of F on the downstream side in the direction of rotation of the photosensitive drum 7 and the developing roller 13, respectively. The movement restricting portion can prevent the interval guarantee member 20 from dropping out from between the photosensitive drum 7 and the developing roller 13 by the same action as descried above. The movement of the interval guarantee member 20 in a direction opposite to the direction of rotation of the photosensitive drum 7 and the developing roller 13 at the time of image forming (the direction indicated by the arrow K) is prevented by the first and the second movement restricting portions 20*e* and 20*f* coming into contact with the photosensitive drum 7 and the developing roller 13, respectively.

In this example as well, in a state in which the photosensitive drum 7 and the developing roller 13 are rotated at the time of the image forming, the first movement restricting portion 20*e* and the second movement restricting portion 20*f* are both out of contact with the photosensitive drum 7 and the developing roller 13.

EXAMPLE 3

In order to reduce variations in the clearance between the photosensitive drum 7 and the developing roller 13 due to the variations in dimension of the interval guarantee member 20, the peripheral shapes of the second drum contact portion 20*a* and the second developing roller contact portion 20*b* of the interval guarantee member 20 are preferably formed into a parallel flat surface. However, the peripheral shapes of the second drum contact portion 20*a* and the second developing roller contact portion 20*b* of the interval guarantee member 20 are not necessarily limited to the parallel flat surfaces as long as the variations in the clearance between the photosensitive drum 7 and the developing roller 13 does not come to an issue in terms of the function of the product.

Figure 11:
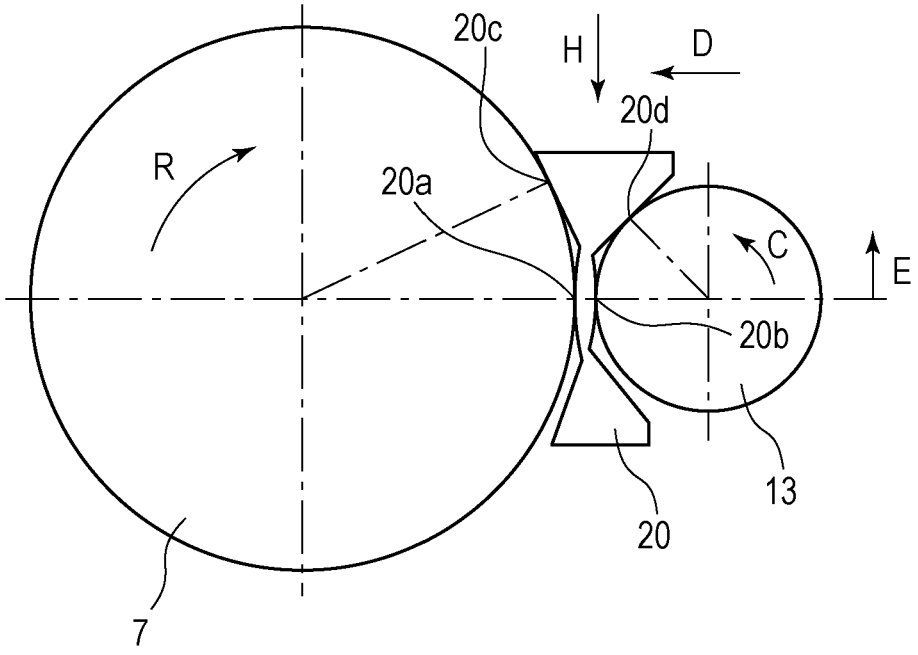
FIG. 11 is a cross-sectional view of the interval guarantee member of Example 3.

In this example, as illustrated in FIG. 11, the peripheral shapes of the second drum contact portion 20*a* and the second developing roller contact portion 20*b* of the interval guarantee member 20 are different from those of the example described above and are formed into curved surfaces. In this configuration as well, the posture of the interval guarantee member 20 at the time of rotation of the photosensitive drum 7 and the developing roller 13 is maintained constant by the first and the second drum contact portion 20*c* and 20*a* and the first and the second developing roller contact portions 20*d* and 20*b*. Accordingly, the clearance between the photosensitive drum 7 and the developing roller 13 is stabilized. As regards the variations in the clearance between the photosensitive drum 7 and the developing roller 13, the variations in the clearance can be suppressed by increasing the radius of curvature of the curved surface so as to make the shape of the curved surface closer to the flat plane by the action described in the example given above.

EXAMPLE 4

Configurations of other examples of this disclosure will be described.

Figure 12:
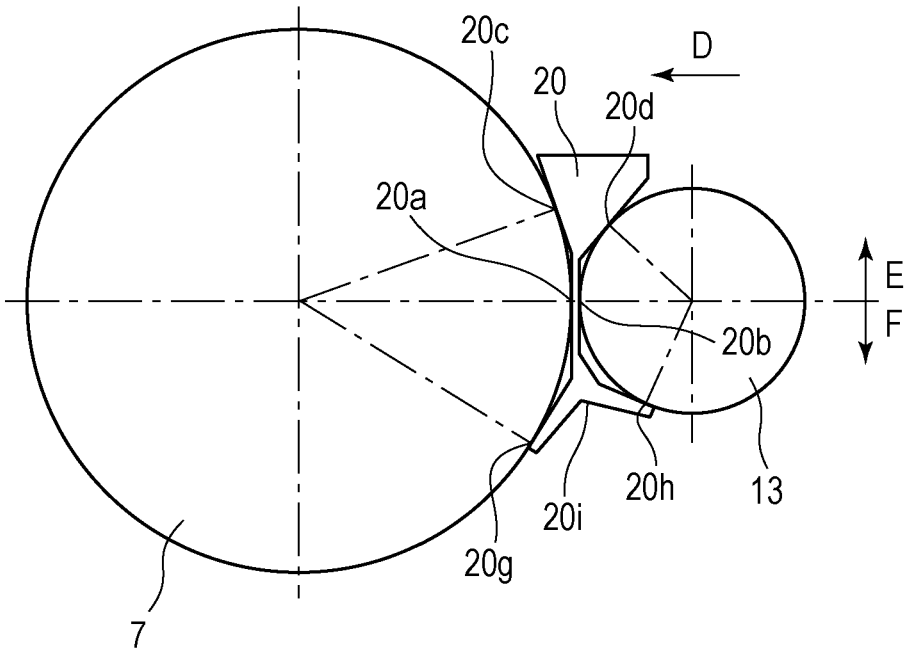
FIG. 12 is a cross-sectional view of the interval guarantee member of Example 4.

In FIG. 12, the interval guarantee member 20 includes the first drum contact portion 20*c*, the first developing roller contact portion 20*d*, the second drum contact portion 20*a*, and the second developing roller contact portion 20*b*, which are contact portions with respect to the photosensitive drum 7 and the developing roller 13. In this example, the interval guarantee member 20 additionally includes a third drum contact portion 20*g* with respect to the photosensitive drum 7, and a third developing roller contact portion 20*h* with respect to the developing roller 13, and hence includes six contact portions as a total. The third drum contact portion 20*g* and the third developing roller contact portion 20*h* are in a region on the downstream side from a line connecting the centers of the photosensitive drum 7 and the developing roller 13 in the direction of rotation as indicated by an arrow F.

In this example, the third drum contact portion 20*g* is the first movement restricting portion, and the third developing roller contact portion 20*h* is the second movement restricting portion. In Examples 1 and 2, the first and the second movement restricting portions 20*e* and 20*f* do not come into contact with the photosensitive drum 7 and the developing roller 13 when the photosensitive drum 7 and the developing roller 13 rotate. In contrast, in this example, the third drum contact portion 20*g* and the third developing roller contact portion 20*h* are in contact with the photosensitive drum 7 and the developing roller 13 respectively even when the photosensitive drum 7 and the developing roller 13 rotate.

Figure 13:
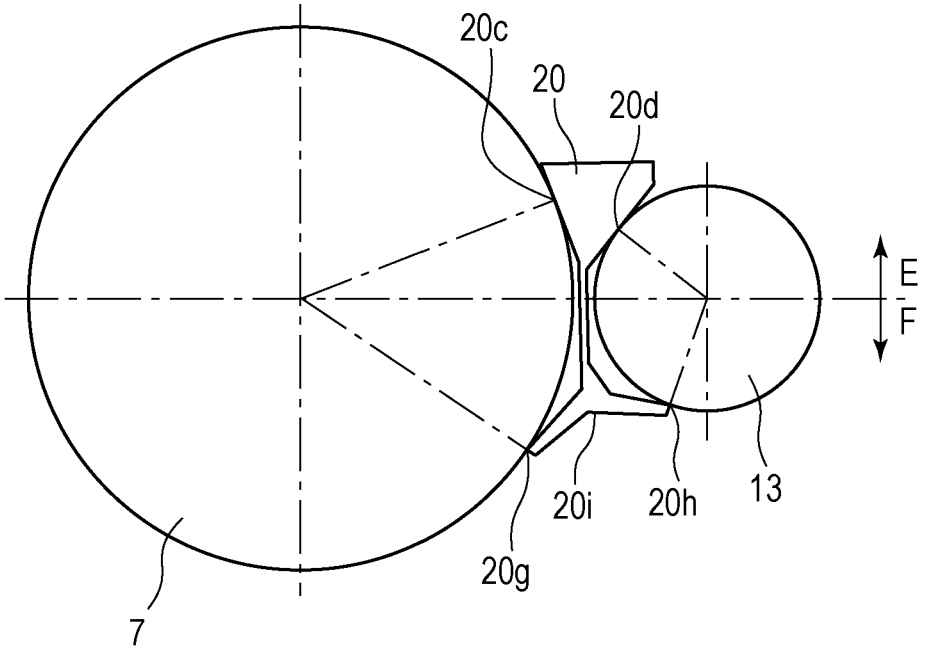
FIG. 13 is a cross-sectional view of the interval guarantee member of Example 4, when there is no urging force.

Here, an urging force from the developing roller 13 in a direction indicated by an arrow D is generated with respect to the photosensitive drum 7. In contrast to FIG. 12, FIG. 13 illustrates a state in which no urging force is generated from the developing roller 13 to the photosensitive drum 7. Here, the interval guarantee member 20 is in contact with the photosensitive drum 7 and the developing roller 13 at four points in total, and in the second drum contact portion 20*a* and the second developing roller contact portion 20*b* illustrated in FIG. 12, the interval guarantee member 20 does not come into contact with the photosensitive drum 7 and the developing roller 13.

In this example, the interval guarantee member 20 is formed of a material having a relatively low coefficient of resiliency such as polyacetal (POM), polypropylene (PP), or polyethylene (PE). A depressed shape 20*i* as illustrated in FIG. 12 and FIG. 13, which allows deformation of the interval guarantee member 20 is formed. In this case, the interval guarantee member 20 may be deformed with flexibility by an urging force from an original shape of the interval guarantee member 20 in a direction indicated by an arrow D illustrated in FIG. 13, and the shape of the interval guarantee member 20 is redressed by the photosensitive drum 7 and the developing roller 13.

Accordingly, irrespective of the dimension of the interval guarantee member 20, the respective contact portions at six points in total illustrated in FIG. 12 come into contact with the photosensitive drum 7 and the developing roller 13.

With the configuration as described above, in the same manner as the case of the examples described above, the posture of the interval guarantee member 20 at the time of rotation of the photosensitive drum 7 and the developing roller 13 is maintained constant by the first and the second drum contact portion 20*c* and 20*a* and the first and the second developing roller contact portions 20*d* and 20*b*. The interval guarantee member 20 has an effect of stabilizing the clearance between the photosensitive drum 7 and the developing roller 13. The third drum contact portion 20*g* and the third developing roller contact portion 20*h* have an effect of preventing the interval guarantee member 20 from dropping out from between the photosensitive drum 7 and the developing roller 13 by the same action as described above.

In other words, the third drum contact portion 20*g* and the third developing roller contact portion 20*g* come into contact with the photosensitive drum 7 and the developing roller 13, whereby the interval guarantee member 20 is prevented from moving in the direction opposite to the direction of rotation of the photosensitive drum 7 and the developing roller 13.

EXAMPLE 5

Figure 14A:
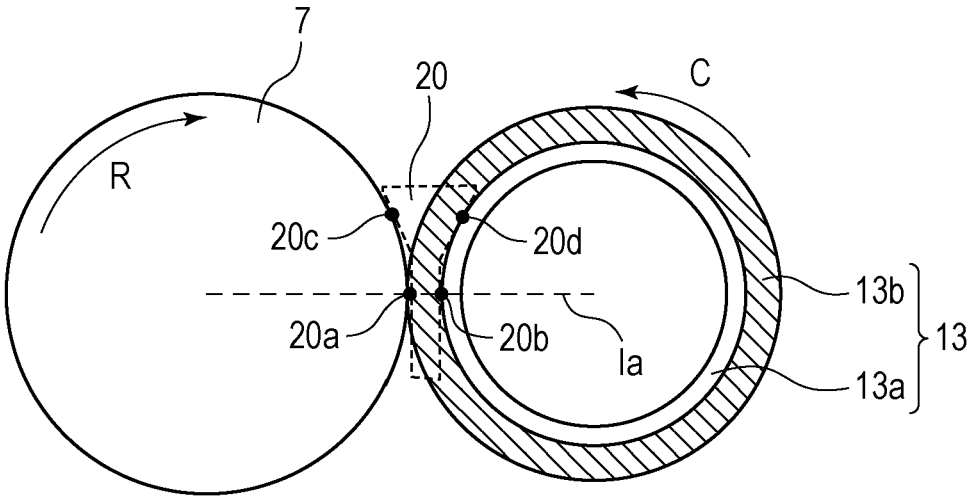
FIG. 14A is a cross-sectional view of the interval guarantee member when the photosensitive drum and the developing roller are driven.

In the respective examples described above, the interval guarantee member 20 has been described on the basis of a case where the constant clearance is provided between the surface of the photosensitive drum 7 and the surface of the developing roller 13. In other words, in the respective examples described above, the interval guarantee member 20 employed in the image forming apparatus in which a noncontact developing system is employed has been described. However, in the image forming apparatus of a contact developing system in which the surfaces of the photosensitive drum 7 and the developing roller 13 come into contact with each other is employed as well, the interval guarantee member 20 may be employed. Description will be given with reference to FIG. 14A and FIG. 14B below. FIG. 14A is a cross sectional view of the photosensitive drum 7 and the developing roller 13 (the drawing illustrating a cross section perpendicular to the axis of the developing roller 13), and FIG. 14B is an explanatory drawing for describing the arrangement of the interval guarantee member 20.

Figure 14B:
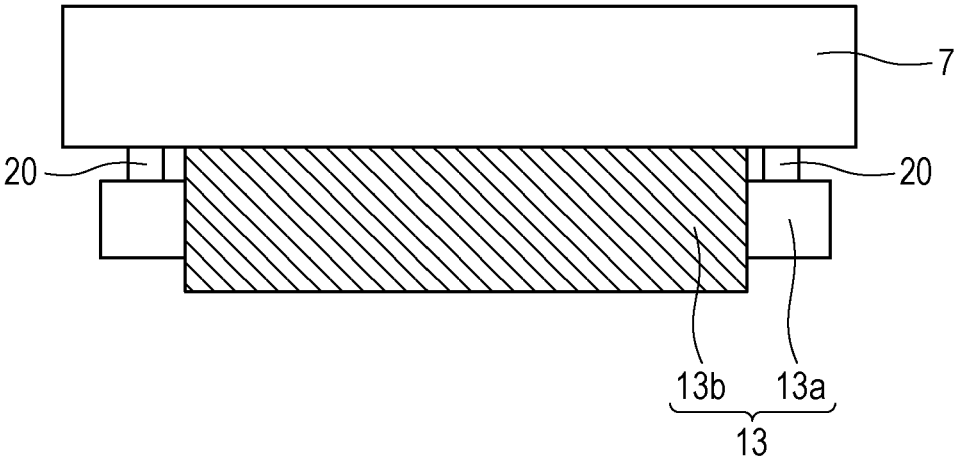
FIG. 14B is a pattern diagram illustrating an arrangement of the interval guarantee member.

The developing roller 13 used in this example includes a cylindrical aluminum sleeve 13*a* and a rubber tube 13*b* as illustrated in FIG. 14A and FIG. 14B. The rubber tube 13*b* covers the surface of the aluminum sleeve 13*a*, and is a resilient portion having resiliency. The interval guarantee member 20 comes into contact with the aluminum sleeve 13*a* at two points, and with the photosensitive drum 7 also at two points.

The interval guarantee member 20 is interposed between the aluminum sleeve 13*a* and the photosensitive drum 7, and maintains the distance between the photosensitive drum 7 and the developing roller 13. In other words, the distance between the center of the photosensitive drum 7 and the center of the developing roller 13 is maintained constant to form a constant clearance between the aluminum sleeve 13*a* and the photosensitive drum 7. At this time, the rubber tube 13*b* comes into contact with the photosensitive drum 7 in a compressed state. The amount of compression of the rubber tube 13*b* is maintained constant by the interval guarantee member 20, and the contact pressure applied when the rubber tube 13*b* comes into contact with the photosensitive drum 7 is maintained constant. Therefore, a toner image (developer image) formed on the surface of the photosensitive drum 7 by the developing roller 13 can be kept at a certain quality.

The first drum contact portion 20*c* and the first developing roller contact portion 20*d* come into sliding contact with the photosensitive drum 7 and the developing roller 13 respectively on the upstream side of the position where the photosensitive drum 7 and the developing roller 13 are closest. The second drum contact portion 20*a* comes into sliding contact with the photosensitive drum 7 on the downstream side of the first drum contact portion 20*c* in the direction of rotation of the photosensitive drum 7. The second developing roller contact portion 20*b* comes into sliding contact with the aluminum sleeve 13*a* on the downstream side of the first developing roller contact portion 20*d* in the direction of rotation of the developing roller 13.

In particular, the second drum contact portion 20*a* and the second developing roller contact portion 20*b* come into contact with the photosensitive drum 7 and the developing roller 13 respectively at a position where the photosensitive drum 7 and the developing roller 13 are the closest. The distance between the photosensitive drum 7 and the developing roller 13 is defined by the distance (thickness) of the second drum contact portion 20*a* and the second developing roller contact portion 20*b*.

In this example, the position where the photosensitive drum 7 and the developing roller 13 are closest means the position where the clearance generated between the photosensitive drum 7 and the aluminum sleeve 13*a* becomes the smallest in FIG. 14A, and a position where the photosensitive drum 7 and the rubber tube 13*b* comes into contact with each other. In other words, in FIG. 14A, the developing roller 13 and the photosensitive drum come closest to each other on the line 1*a* passing through the center of the photosensitive drum 7 and the center of the developing roller 13. The line 1*a* passes through the second drum contact portion 20*a* and the second developing roller contact portion 20*b*. The first drum contact portion 20*c* and the first developing roller contact portion 20*d* are positioned on the upstream side of the line 1*a* in the direction of rotation of the photosensitive drum 7 and the developing roller 13.

As a summary of the description given above, the interval guarantee member 20 of this example maintains the distance between the developing roller 13 and the photosensitive drum 7 (the interval between the center of the developing roller 13 and the center of the photosensitive drum 7) constant in a state in which the surface of the developing roller 13 and the surface of the photosensitive drum 7 are partly in contact with each other. Accordingly, the interval guarantee member 20 maintains the contact pressure at which the developing roller 13 and the photosensitive drum 7 come into contact with each other and the amount of compression of the rubber tube 13*b* (the amount of collapse) constant.

Advantages of Respective Examples

In the respective examples described above, the advantages that the interval guarantee member 20 achieves is summarized as follows. The interval guarantee member 20 may be maintained the distance between the image bearing member and the developer bearing member stably with a simple configuration.

More specifically, the interval guarantee member 20 disclosed in this application is a further improvement of the related art and, even when there are variations in dimension of the interval guarantee members, variations in distance between the photosensitive drum and the developing roller are suppressed. Accordingly, the interval guarantee member 20 enables a stable interval guarantee with high degree of accuracy. Furthermore, the interval guarantee member 20 does not require a fixing device (i.e., double-faced adhesive tape) for fixing the interval guarantee member 20 to the frame of the process cartridge or the like (the double-faced adhesive tape may not be provided). Therefore, the configuration of the interval guarantee member 20 may be simplified and compact.

In the respective examples described above, the interval guarantee members 20 are provided in the process cartridge B and the process cartridge B is configured to be detachably attachable to the main body of the image forming apparatus A. However, the configuration of this disclosure is not limited to such a mode. The photosensitive drum 7, and the developing roller 13 and the interval guarantee member 20 may have configurations which do not allow the user to replace. The developing unit (developing apparatus) u and the cleaning unit v may be configured to be detachably attachable with respect to the main body of the image forming apparatus A as separate cartridges, respectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-090803 filed Apr. 23, 2013, which is hereby incorporated by reference herein in its entirety.

What is claimed is:

1. An interval guarantee member configured to maintain a distance between an image bearing member on which a latent image is formed and a developer bearing member configured to bear a developer, comprising:

a first image bearing member side sliding portion configured to come into sliding contact with the image bearing member on an upstream side of a line connecting a center of the image bearing member and a center of the developer bearing member in the direction of rotation of the image bearing member when the image bearing member and the developer bearing member rotate so that surfaces oppose to each other thereof move in the same direction;

a first developing side sliding portion configured to come into sliding contact with the developer bearing member on an upstream side of a line connecting a center of the image bearing member and a center of the developer bearing member in the direction of rotation of the developer bearing member when the image bearing member and the developer bearing member rotate so that surfaces oppose to each other thereof move in the same direction;

a second image bearing member side sliding contact portion configured to come into sliding contact with the image bearing member on an downstream side of the first image bearing member side sliding portion in the direction of rotation of the image bearing member; and a second developing side sliding contact portion configured to come into sliding contact with the developer bearing member on an downstream side of the first developing side sliding contact portion in the direction of rotation of the developer bearing member, wherein a distance between the first image bearing member side sliding contact portion and the first developing side sliding contact portion is longer than a distance between the second image bearing member side sliding contact portion and the second developing side sliding contact portion, and the first image bearing member side sliding contact portion and the first developer side sliding contact portion come into contact with the image bearing member and the developer bearing member respectively, whereby the interval guarantee member is prevented from moving in the direction of rotation of the image bearing member and the developer bearing member.

2. The interval guarantee member according to claim 1, wherein the second image bearing member side sliding contact portion and the second developing side sliding contact portion are arranged on a line connecting the center of the image bearing member and the center of the developer bearing member when the image bearing member and the developer bearing member rotate.

3. The interval guarantee member according to claim 1, wherein the second image bearing member side sliding contact portion and the second developing side sliding contact portion come into contact with the image bearing member and the developer bearing member respectively at a position where the developer bearing member and the image bearing member are closest.

4. The interval guarantee member according to claim 1, wherein the distance between the image bearing member and the developer bearing member is defined by the distance between the second image bearing member side sliding contact portion and the second developing side sliding contact portion.

5. The interval guarantee member according to claim 1, wherein the second image bearing member side sliding contact portion and the second developing side sliding contact portion are formed respectively on two flat surfaces parallel to each other.

6. The interval guarantee member according to claim 1, further comprising:

a first movement restricting portion provided on a downstream side of the second image bearing member side sliding contact portion in the direction of rotation of the image bearing member; and a second movement restricting portion provided on a downstream side of the second developing side sliding contact portion in the direction of rotation of the developer bearing member, wherein a distance between the first movement restricting portion and the second movement restricting portion is longer than the distance between the second image bearing member side sliding contact portion and the second developing side sliding contact portion, and when the interval guarantee member is about to move in a direction opposite to the direction of rotation of the image bearing member and the developer bearing member, the first movement restricting portion and the second movement restricting portion come into contact with the image bearing member and the developer bearing member respectively to prevent the movement thereof.

7. The interval guarantee member according to claim 6, wherein at least one of the first movement restricting portion and the second movement restricting portion maintains a state of contact with the image bearing member or the developer bearing member when the image bearing member and the developer bearing member rotate.

8. The interval guarantee member according to claim 6, wherein at least one of the first movement restricting portion and the second movement restricting portion are arranged at a distance from the image bearing member or the developer bearing member when the image bearing member and the developer bearing member rotate.

9. The interval guarantee member according to claim 1, wherein the interval guarantee member maintains the distance between the developer bearing member and the image bearing member in a state in which the surface of the developer bearing member and the surface of the image bearing member are kept out of contact with each other.

10. The interval guarantee member according to claim 1, wherein the interval guarantee member maintains the distance between the developer bearing member and the image bearing member in a state in which the surface of the developer bearing member and the surface of the image bearing member are in contact with each other.

11. The interval guarantee member according to claim 10, wherein a resilient portion is provided on the surface of the developer bearing member, and the resilient portion comes into contact with the surface of the image bearing member.

12. A developing apparatus used in an image forming apparatus, comprising:

a developer bearing member configured to bear a developer for developing the latent image and rotate so that the surface thereof moves in the same direction as the image bearing member at an area opposing each other; and an interval guarantee member configured to maintain a distance between the image bearing member and the developer bearing member, wherein the interval guarantee member includes:

a first image bearing member side sliding portion configured to come into sliding contact with the image bearing member on an upstream side of a line connecting a center of the image bearing member and a center of the developer bearing member when the image bearing member and the developer bearing member rotate so that surfaces oppose to each other thereof move in the same direction;

a first developing side sliding portion configured to come into sliding contact with the developer bearing member on an upstream side of a line connecting a center of the image bearing member and a center of the developer bearing member in the direction of rotation of the image bearing member when the image bearing member and the developer bearing member rotate so that surfaces oppose to each other thereof move in the same direction;

a second image bearing member side sliding contact portion configured to come into sliding contact with the image bearing member on an downstream side of the first image bearing member side sliding portion in the direction of rotation of the image bearing member; and a second developing side sliding contact portion configured to come into sliding contact with the developer bearing member on an downstream side of the first developing side sliding contact portion in the direction of rotation of the developer bearing member, wherein a distance between the first image bearing member side sliding contact portion and the first developing side sliding contact portion is longer than a distance between the second image bearing member side sliding contact portion and the second developing side sliding contact portion, and the first image bearing member side sliding contact portion and the first developer side sliding contact portion come into contact with the image bearing member and the developer bearing member respectively, whereby the interval guarantee member is prevented from moving in the direction of rotation of the image bearing member and the developer bearing member.

13. The developing apparatus according to claim 12, wherein the second image bearing member side sliding contact portion and the second developing side sliding contact portion are arranged on a line connecting the center of the image bearing member and the center of the developer bearing member when the image bearing member and the developer bearing member rotate.

14. The developing apparatus according to claim 12, wherein the second image bearing member side sliding contact portion and the second developing side sliding contact portion come into contact with the image bearing member and the developer bearing member respectively at a position where the developer bearing member and the image bearing member are closest.

15. The developing apparatus according to claim 12, wherein the distance between the image bearing member and the developer bearing member is defined by the distance between the second image bearing member side sliding contact portion and the second developing side sliding contact portion.

16. The developing apparatus according to claim 12, wherein the second image bearing member side sliding contact portion and the second developing side sliding contact portion are formed respectively on two flat surfaces parallel to each other.

17. The developing apparatus according to claim 12, wherein the interval guarantee member includes:

the first movement restricting portion provided on a downstream side of the second image bearing member side sliding contact portion in the direction of rotation of the image bearing member; and the second movement restricting portion provided on a downstream side of the second developing side sliding contact portion in the direction of rotation of the developer bearing member, wherein a distance between the first movement restricting portion and the second movement restricting portion is longer than the distance between the second image bearing member side sliding contact portion and the second developing side sliding contact portion, and when the interval guarantee member is about to move in a direction opposite to the direction of rotation of the image bearing member and the developer bearing member, the first movement restricting portion and the second movement restricting portion come into contact with the image bearing member and the developer bearing member respectively to prevent the movement thereof.

18. The developing apparatus according to claim 17, wherein at least one of the first movement restricting portion and the second movement restricting portion maintains a state of contact with the image bearing member or the developer bearing member when the image bearing member and the developer bearing member rotate.

19. The developing apparatus according to claim 17, wherein at least one of the first movement restricting portion and the second movement restricting portion are arranged at a distance from the image bearing member or the developer bearing member when the image bearing member and the developer bearing member rotate.

20. The developing apparatus according to claim 12, wherein the interval guarantee member maintains the distance between the developer bearing member and the image bearing member so that the surface of the developer bearing member and the surface of the image bearing member are out of contact with each other.

21. The developing apparatus according to claim 12, wherein the interval guarantee member maintains the distance between the developer bearing member and the image bearing member in a state in which the surface of the developer bearing member and the surface of the image bearing member are in contact with each other.

22. The developing apparatus according to claim 12, wherein a resilient portion is provided on the surface of the developer bearing member, and the resilient portion comes into contact with the surface of the image bearing member.

23. A process cartridge configured to be detachably attachable to a main body of an image forming apparatus comprising:

an image bearing member configured so that a latent image is formed thereon;

a developer bearing member configured to bear a developer for developing the latent image and rotate so that the surface thereof moves in the same direction as the image bearing member at an area opposing each other; and an interval guarantee member configured to maintain the distance between the image bearing member and the developer bearing member, wherein the interval guarantee member includes:

a first image bearing member side sliding portion configured to come into sliding contact with the image bearing member on an upstream side of a line connecting a center of the image bearing member and a center of the developer bearing member in the direction of rotation of the image bearing member when the image bearing member and the developer bearing member rotate so that surfaces oppose to each other thereof move in the same direction;

a first developing side sliding portion configured to come into sliding contact with the developer bearing member on an upstream side of a line connecting a center of the image bearing member and a center of the developer bearing member in the direction of rotation of the developer bearing member when the image bearing member and the developer bearing member rotate so that surfaces oppose to each other thereof move in the same direction;

a second image bearing member side sliding contact portion configured to come into sliding contact with the image bearing member on an downstream side of the first image bearing member side sliding portion in the direction of rotation of the image bearing member; and a second developing side sliding contact portion configured to come into sliding contact with the developer bearing member on an downstream side of the first developing side sliding contact portion in the direction of rotation of the developer bearing member, wherein a distance between the first image bearing member side sliding contact portion and the first developing side sliding contact portion is longer than the distance between the second image bearing member side sliding contact portion and the second developing side sliding contact portion, and the first image bearing member side sliding contact portion and the first developer side sliding contact portion come into contact with the image bearing member and the developer bearing member respectively, whereby the interval guarantee member is prevented from moving in the direction of rotation of the image bearing member and the developer bearing member.

24. The process cartridge according to claim 23, wherein the second image bearing member side sliding contact portion and the second developing side sliding contact portion are arranged on a line connecting the center of the image bearing member and the center of the developer bearing member when the image bearing member and the developer bearing member rotate.

25. The process cartridge according to claim 23, wherein the second image bearing member side sliding contact portion and the second developing side sliding contact portion come into contact with the image bearing member and the developer bearing member respectively at a position where the developer bearing member and the image bearing member are closest.

26. The process cartridge according to claim 23, wherein the distance between the image bearing member and the developer bearing member is defined by the distance between the second image bearing member side sliding contact portion and the second developing side sliding contact portion.

27. The process cartridge according to claim 23, wherein the second image bearing member side sliding contact portion and the second developing side sliding contact portion are formed respectively on two flat surfaces parallel to each other.

28. The process cartridge according to claim 23, wherein the interval guarantee member includes:

the first movement restricting portion provided on a downstream side of the second image bearing member side sliding contact portion in the direction of rotation of the image bearing member; and the second movement restricting portion provided on a downstream side of the second developing side sliding contact portion in the direction of rotation of the developer bearing member, and wherein a distance between the first movement restricting portion and the second movement restricting portion is longer than the distance between the second image bearing member side sliding contact portion and the second developing side sliding contact portion, and when the interval guarantee member is about to move in a direction opposite to the direction of rotation of the image bearing member and the developer bearing member, the first movement restricting portion and the second movement restricting portion come into contact with the image bearing member and the developer bearing member respectively to prevent the movement thereof.

29. The process cartridge according to claim 28, wherein at least one of the first movement restricting portion and the second movement restricting portion maintains a state of contact with the image bearing member or the developer bearing member when the image bearing member and the developer bearing member rotate.

30. The process cartridge according to claim 28, wherein at least one of the first movement restricting portion and the second movement restricting portion are arranged at a distance from the image bearing member or the developer bearing member when the image bearing member and the developer bearing member rotate.

31. The process cartridge according to claim 28, wherein the interval guarantee member maintains the distance between the developer bearing member and the image bearing member in a state in which the surface of the developer bearing member and the surface of the image bearing member are out of contact with each other.

32. The process cartridge according to claim 28, wherein the interval guarantee member maintains the distance between the developer bearing member and the image bearing member in a state in which the surface of the developer bearing member and the surface of the image bearing member are in contact with each other.

33. The process cartridge according to claim 28, wherein a resilient portion is provided on the surface of the developer bearing member, and the resilient portion comes into contact with the surface of the image bearing member.

* * * * *